US011930900B2

(12) United States Patent
Smith

(10) Patent No.: US 11,930,900 B2
(45) Date of Patent: Mar. 19, 2024

(54) HANDBAG WITH ADJUSTABLE CLOSURE FLAPS

(71) Applicant: Shavon Smith, Westminster, CA (US)

(72) Inventor: Shavon Smith, Westminster, CA (US)

( * ) Notice: Subject to any disclaimer, the term of this patent is extended or adjusted under 35 U.S.C. 154(b) by 191 days.

(21) Appl. No.: 17/702,900

(22) Filed: Mar. 24, 2022

(65) Prior Publication Data

US 2022/0304433 A1 Sep. 29, 2022

Related U.S. Application Data

(60) Provisional application No. 63/167,541, filed on Mar. 29, 2021.

(51) Int. Cl.

| | |
|---|---|
| ***A45C 1/02*** | (2006.01) |
| ***A45C 3/06*** | (2006.01) |
| ***A45C 13/26*** | (2006.01) |

(52) U.S. Cl.

CPC ..... *A45C 1/02* (2013.01); *A45C 3/06* (2013.01); *A45C 13/26* (2013.01)

(58) Field of Classification Search

CPC ..... A45C 1/02; A45C 3/06; A45C 13/26

See application file for complete search history.

(56) References Cited

U.S. PATENT DOCUMENTS

| | | | | | |
|---|---|---|---|---|---|
| 1,771,168 | A * | 7/1930 | Droutman | A45C 3/06 | 383/38 |
| 2,534,179 | A * | 12/1950 | Peterson | A45C 15/06 | D26/37 |
| 4,194,601 | A * | 3/1980 | Yellin | A47C 1/146 | 5/419 |
| 4,823,943 | A * | 4/1989 | Chang | A45C 11/005 | D3/264 |
| 6,070,628 | A * | 6/2000 | Nastasi | A45C 13/1069 | 190/902 |
| 7,458,491 | B2 * | 12/2008 | Cragg | A45F 3/14 | 224/648 |
| 7,617,917 | B2 * | 11/2009 | Hai | A01K 1/0254 | 190/106 |
| 8,408,791 | B1 * | 4/2013 | Wang | B65D 33/02 | 383/104 |
| D805,768 | S * | 12/2017 | Nicotra | D3/232 | |
| D813,543 | S * | 3/2018 | Wang | D3/305 | |
| D972,838 | S * | 12/2022 | Byrd | D3/232 | |

* cited by examiner

*Primary Examiner* — Tri M Mai

(74) *Attorney, Agent, or Firm* — Fish & Richardson P.C.

(57) ABSTRACT

This document describes a handbag that includes: a bag-shaped body that defines an opening for receiving personal items; a handle for carrying the handbag, the handle being attached to the body; and a first and second flap each attached to the body along opposing edges of the opening, wherein the first and second flaps can be secured in a first position, in which the flaps overlap one another to substantially close the opening of the body, and in a second position, in which each flap extends away from the opening, along a side of the body.

9 Claims, 13 Drawing Sheets

HANDBAG WITH ADJUSTABLE CLOSURE FLAPS

CROSS-REFERENCE TO RELATED APPLICATIONS

This application claims the benefit of U.S. Patent Application No. 63/167,541, filed Mar. 29, 2021, which is incorporated herein by reference.

FIELD

This specification generally relates to bags for carrying personal belongings.

BACKGROUND

There are already many types of bags that enable people to carry their personal belongings. Some of these bags are, for example, handbags, tote bags, briefcases, and clutch bags. Handbags or purses typically include a body that stores the wearer's personal belongings and a handle or strap for carrying the body.

SUMMARY

This specification generally describes handbags. According to a first aspect, a handbag comprises a bag-shaped body that defines an opening for receiving personal items; a handle for carrying the handbag, the handle being attached to the body; and a first and second flap each attached to the body along opposing edges of the opening, wherein the first and second flaps can be secured in a first position, in which the flaps overlap one another to substantially close the opening of the body, and in a second position, in which each flap extends away from the opening, along a side of the body. In some implementations, the first and second flap may be integrally attached to the body along opposing edges of the opening, such that there is no visible seam at the attachment. In some implementations, the first and second flap may be attached to the opposing edges of the body's opening along a seam.

Implementations can include one or more of the following features.

In some implementations, the body defines a longitudinally extending channel, and wherein the handle comprises a hoop received in the channel. The hoop can include a length of material having a first end and a second end, wherein the length of material is bent into a circular shape with the first end and second end disposed adjacent to one another.

In some implementations, the body and the first flap and the second flap define a first circular side and a second circular side.

In some implementations, the first flap and the second flap each comprise a peripheral magnet arranged at a periphery of the flap and a flap magnet arranged adjacent the body, wherein in the first position, the peripheral magnet of the first flap is configured to engage the flap magnet of the second flap, and the peripheral magnet of the second flap is configured to engage the flap magnet of the first flap. The body can include a first body magnet and a second body magnet, wherein in the second position, the first peripheral magnet and the first body magnet are configured to engage, and the second peripheral magnet and the second body magnet are configured to engage. The first flap and second flap can each include a further pair of peripheral magnets, wherein the peripheral magnets of the first flap are configured to engage the peripheral magnets of the second flap when the first flap and second flap are in the first position.

In some implementations, the handbag includes a first inner flap and a second inner flap that are arranged to close off the opening of the body in the second position of the first and second flaps.

In some implementations, the handbag includes a light configured to illuminate an interior of the body.

In some implementations, the handbag includes a pocket arranged in an interior of the body.

According to a second aspect of the present disclosure, a handbag includes a bag-shaped body that defines an opening for receiving personal items; and a first and second flap each attached to the body along opposing edges of the opening, wherein the first and second flaps can be secured in a first position, in which the flaps overlap one another to substantially close the opening of the body, and in a second position, in which each flap extends away from the opening, along a side of the body; wherein the first flap and the body define a first circular side, and the second flap and the body define a second circular side; and wherein the first flap comprises first peripheral magnets arranged along the periphery of the first flap, and the second flap comprises second peripheral magnets arranged along the periphery of the second flap, wherein the first peripheral magnets are configured to engage the second peripheral magnets when the first flap and second flap are arranged in the first position.

Implementations can include one or more of the following features.

In some implementations, the body defines a pair of longitudinal channels that extend along a periphery of the body, wherein each channel receives a hoop-shaped handle that encircles the body. The hoop-shaped handles can be made of a ferromagnetic material that attracts the first peripheral magnets and the second peripheral magnets. Each of the hoop-shaped handle can include a carabiner connecter that allows the hoop-shaped handle to be removed from the longitudinal channel. The handbag can include a pair of rings threaded on the hoop-shaped handles, wherein the pair of rings have a substantially smaller diameter than the hoop-shaped handles. The handbag can also include a detachable chain or strap configured to connect to the bag-shaped body.

In some implementations, the body comprises a first body magnet and a second body magnet, wherein in the second position, at least one of the first peripheral magnets is configured to engage the first body magnet, at least one of the second peripheral magnets is configured to engage the second body magnet.

In some implementations, the handbag includes a first inner flap and a second inner flap that are arranged to close off the opening of the body in the second position of the first and second flaps.

In some implementations, the handbag includes a light configured to illuminate an interior of the body.

In some implementations, the handbag includes a pocket arranged in an interior of the body.

This specification also describes a method of manufacturing a handbag. The method in accordance with the present disclosure can include any combination of the aspects and features described herein. That is, methods in accordance with the present disclosure are not limited to the combinations of aspects and features specifically described herein, but also may include any combination of the aspects and features provided.

The subject matter described in this specification can be implemented in particular embodiments and may result in one or more of the following advantages. The present disclosure generally provides a handbag with flaps that can be arranged in different ways to easily modify the function and appearance of the bag. The flaps can be arranged in one or more of the following configurations: folded down outside of the bag body, folded down into the bag body, overlapping one another, and extending in an upright position. Not only do the different flap configurations change the appearance of the handbag, they adapt the handbag to a variety of functions and situations. The upright position and folded down positions offer the user an unobstructed view to the bottom of the bag. In the upright position, the flaps can act as a privacy screen, allowing the user to securely search for their belonging without being seen by onlookers. In the overlapping position, the bag can secure the user's belongings and fold down to a compact, clutch-like shape. In some cases, the handbag has a circular shape that shifts heavier items to the center and lighter items outward to make belongings in the bag easier to find. Some versions of the handbag include one or more of a removable chain, hoop-shaped removable handles, and optional bracelet-style rings. These items allow the bag to be worn in different ways (cross-body, shoulder, clutch, etc.) depending on the situation and to reduce the burden placed on the user's body. Embodiments of the handbag can replace numerous different bags with a single, flexible, and stylish product.

The details of one or more implementations of the present disclosure are set forth in the accompanying drawings and the description below. Other features and advantages of the present disclosure will be apparent from the description and drawings, and from the claims.

DETAILED DESCRIPTION

Figure 1A:
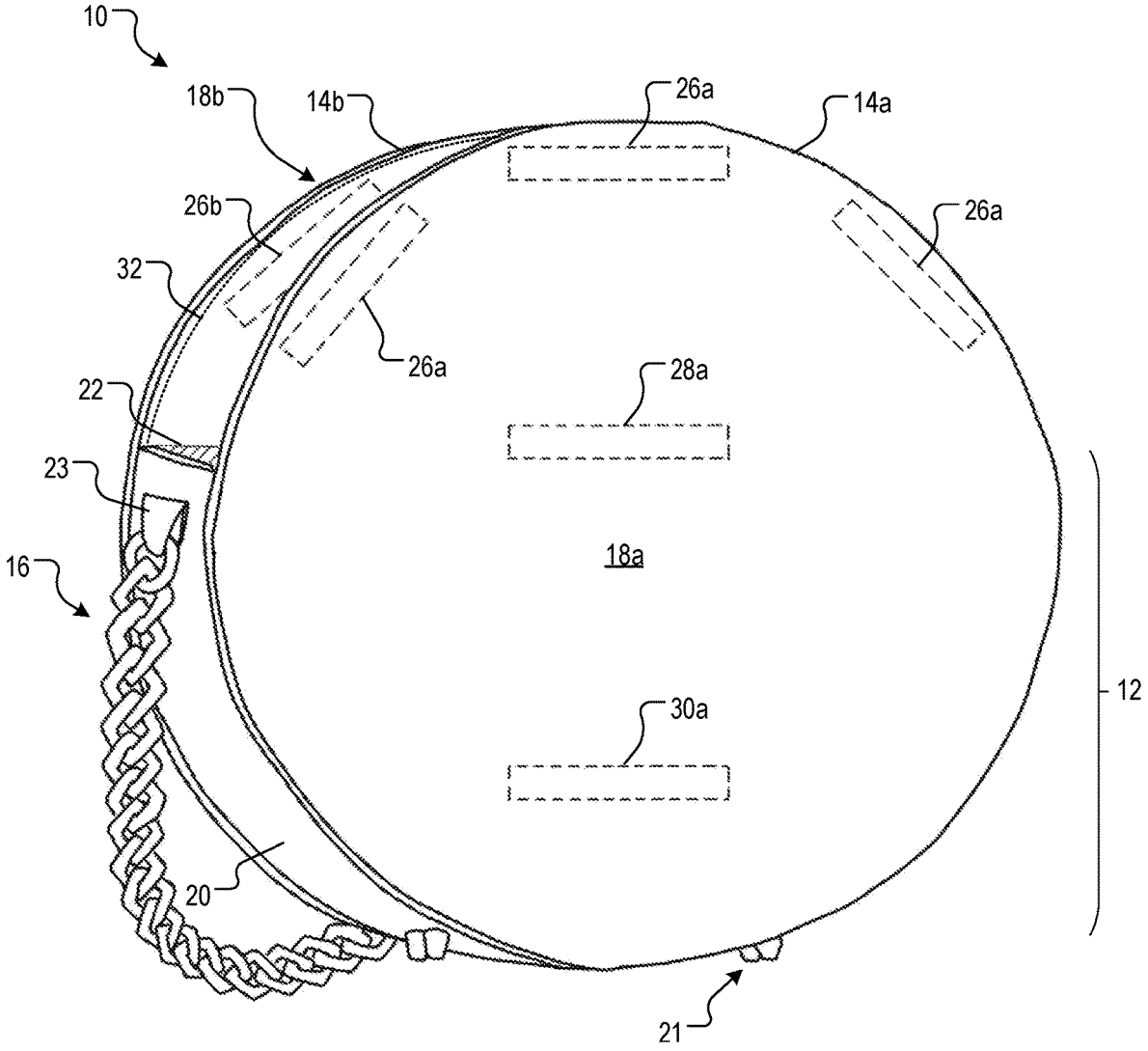
FIGS. 1A-1F show various views of an example handbag.

FIGS. 1A-1F show various views of an example handbag 10. Briefly, the handbag 10 includes a bag-shaped receptacle or body 12 that forms a space for personal belongings, two flaps 14*a*, 14*b* that are connected to the body 12, and a chain 16 or strap (omitted from FIGS. 1C, 1E, and 1F) for carrying the body 12. The flaps and body 12 form two circular sides 18*a*, 18*b* of the handbag 10 (FIG. 1A). The body 12 also includes a strip of material that forms a base 20 and connects about half to two-thirds of the circumference of the sides 18*a*, 18*b*. Multiple feet 21 can be attached to the base 20 to allow the handbag 10 to stand on a flat surface and to protect the material of the base 20 from wear and tear. The body 12 includes a substantially rectangular opening 22, shown in FIG. 1B. The chain 16 can be attached at each end to the base 20, in the vicinity of the opening 22, by an attachment loop 23 of fabric. In some instances, the chain 16 can include a clasp (e.g., a spring ring, lobster claw, toggle, or hook) to attach and detach the chain 16 from the loop 23. Some versions of the handbag 10 can include a grommet or opening in place of the attachment loop 23. As described in more detail in reference to FIG. 2, the handbag 10 can also include optional and removable handles.

Figure 1B:
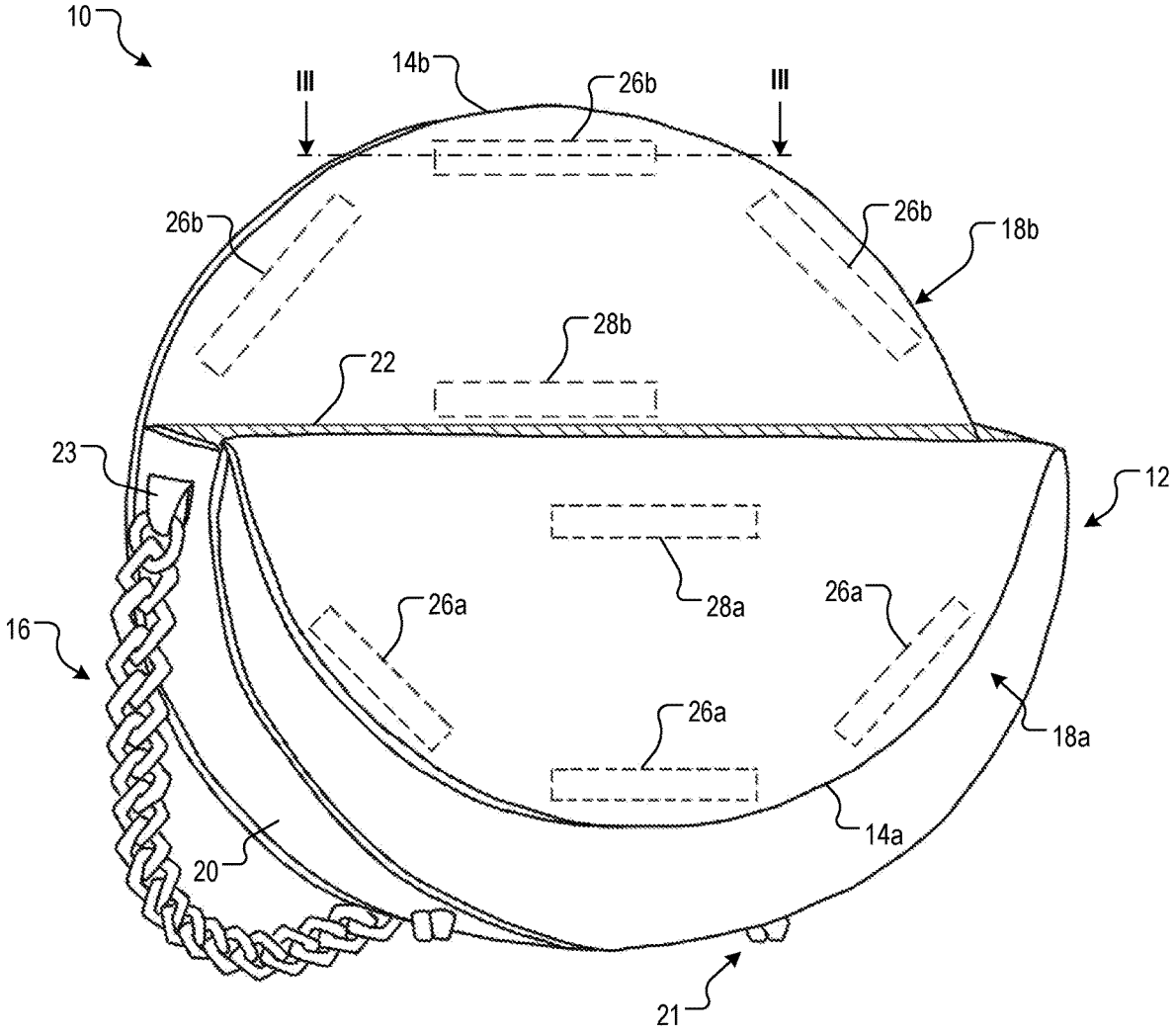
Figure 1C:
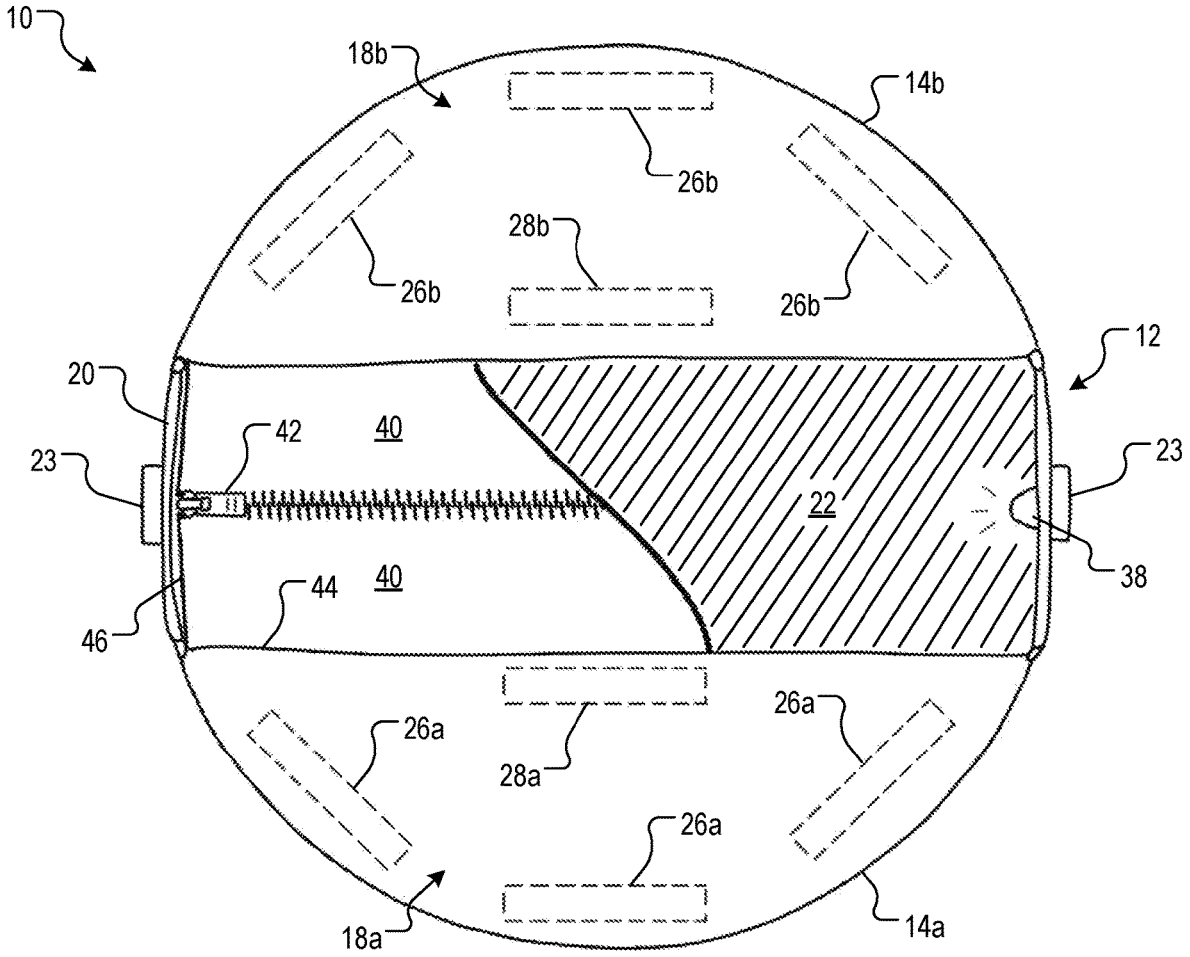
Figure 1D:
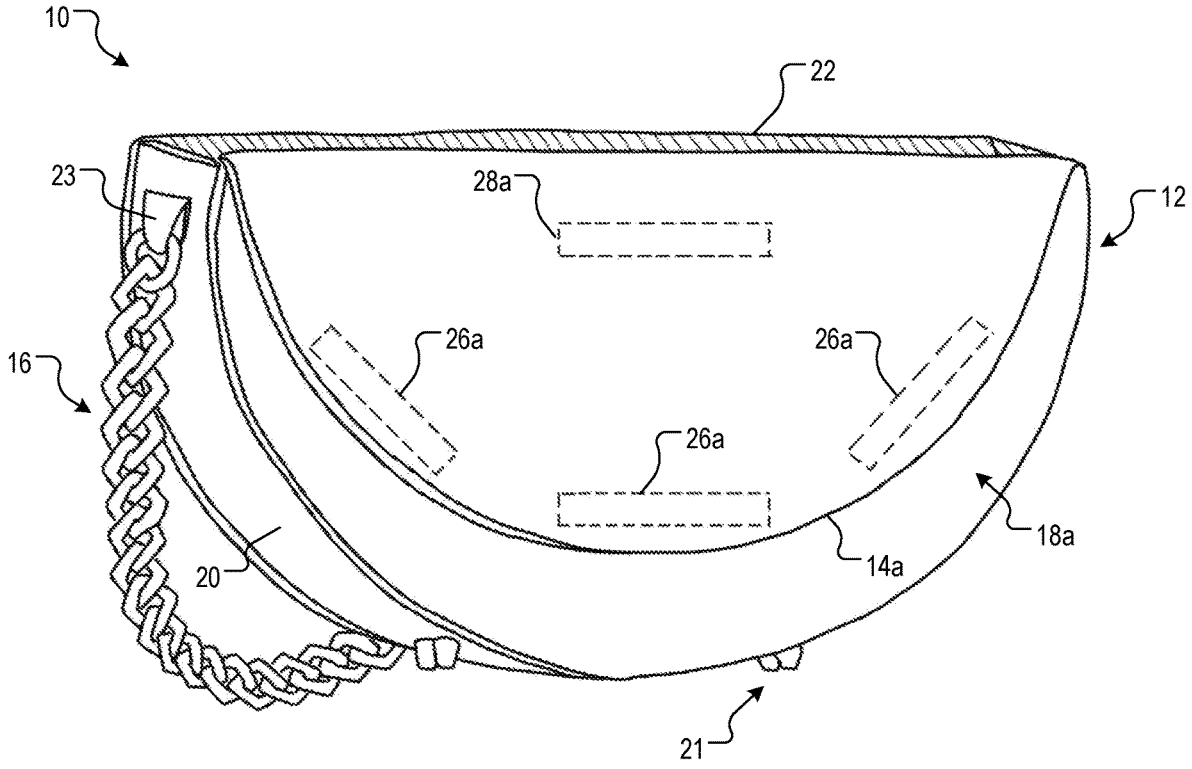
Figure 1E:
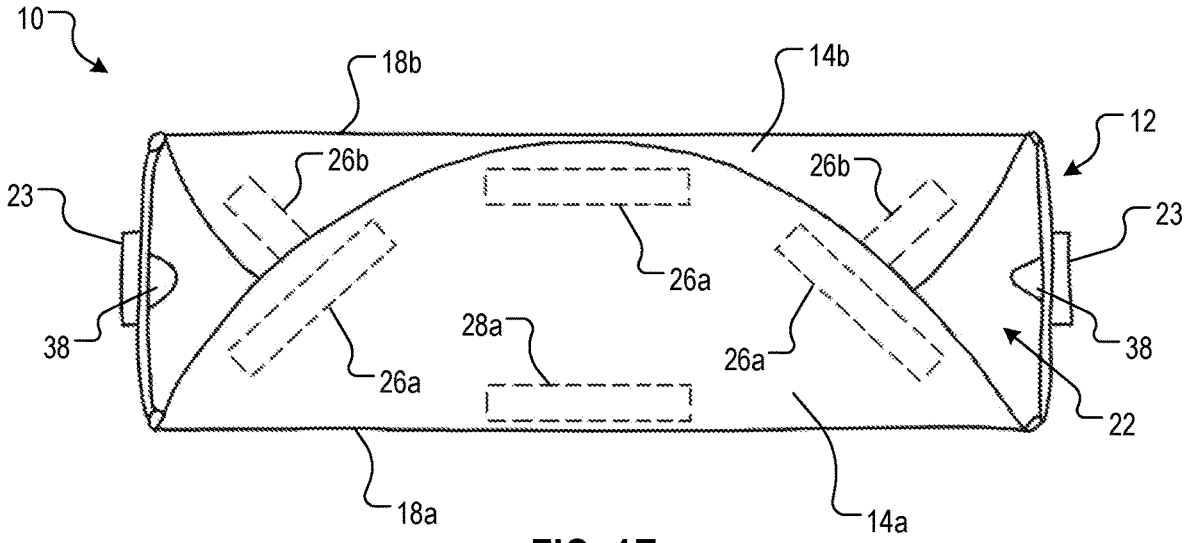
Figure 1F:
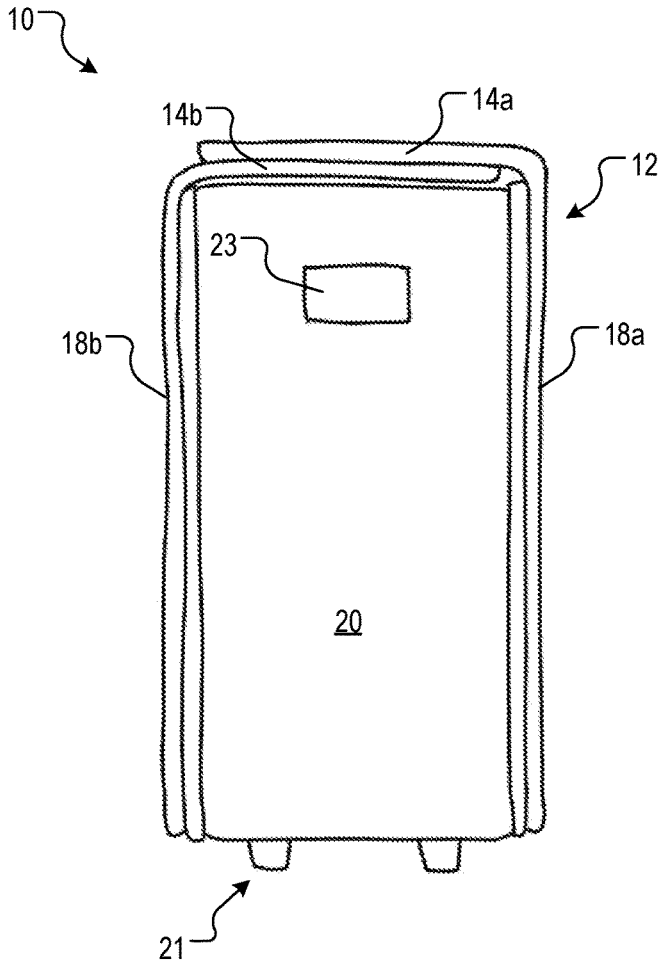

As shown, the flaps 14*a*, 14*b* can be arranged in an upright position (FIG. 1A), a folded down position (FIG. 1D), or an overlapping position (FIGS. 1E-1F). The flaps 14*a*, 14*b* and body 12 include a plurality of concealed magnets 26*a*, 26*b*, 28*a*, 28*b*, 30*a*, 30*b* that are arranged to secure the flaps 14*a*, 14*b* in at least the folded down and overlapping positions. As described below in more detail, the concealed magnets 26*a*, 26*b*, 28*a*, 28*b*, 30*a*, 30*b* can be arranged between layers of material that form the sides 18*a*, 18*b* of the handbag 10. Although magnets 26*a*, 26*b*, 28*a*, 28*b*, 30*a*, 30*b* are illustrated in the figures, other alternatives, for example, snap closures or hook and loop closures, are also contemplated. Unlike the concealed magnets 26*a*, 26*b*, 28*a*, 28*b*, 30*a*, 30*b*, other types of hardware may be arranged on the outer surface of the sides 18*a*, 18*b*.

In the upright position depicted in FIG. 1A, the flaps 14*a*, 14*b* extend upwards from the body 12 to form a circular shape. In this flap position, the wearer has access to the opening 22 of the handbag 10, although the opening 22 is shielded to some extent by the tall flaps 14*a*, 14*b*. In some cases, the material of the body 12 and flaps 14*a*, 14*b* has a stiffness that allows the flaps 14*a*, 14*b* to remain in the upright position on their own, e.g., remain upright without attaching the flaps 14*a*, 14*b* to another part of the handbag 10. In some examples, a peripheral portion of the flaps 14*a*, 14*b* can include a stiffening wire 32 (shown schematically for flap 14*b* in FIG. 1A) that holds the flaps 14*a*, 14*b* in any of the positions depicted in FIGS. 1A-1F. In some cases, one or more of the magnets 26*a*, 26*b* may be used to hold the flaps 14*a*, 14*b* in the upright position. For example, the handbag 10 may include one or more metal hoops 34*a*, 34*b* (FIGS. 2A-2C) that attracts one or more of the peripheral magnets 26*a*, 26*b* along an edge of the flap 14*a*, 14*b*. In this case, the metal hoops 34 may form an optional frame for the handbag 10, while the handbag 10 can be worn by the chain 16.

From the upright position, the flaps 14*a*, 14*b* can be folded downwards and away from one another to give greater access to the handbag opening 22. For example, FIG. 1B shows a comparison in which one flap 14*a* has been folded down and secured, while the other flap 14*b* remains in an upright position. FIG. 1C shows the transition from the upright position to the folded down position from above. In FIG. 1C, the flaps 14*a*, 14*b* have been folded down halfway and are positioned at approximately a 90° angle relative to the body 12. FIG. 1D depicts the flaps 14*a*, 14*b* in the secured, folded down position. In order to secure the flaps 14*a*, 14*b* in the folded down position (FIG. 1D), one or more peripheral magnets 26*a*, 26*b* in the flap 14*a*, 14*b* can attach to a corresponding body magnet 30*a*, 30*b* positioned in the handbag body 12 (FIG. 1A). In the folded down position shown, e.g., in FIG. 1D, the overall height of the handbag 10 can be approximately half to two-thirds of the height of the upright position shown in FIG. 1A. In cases where the handbag 10 is provided with additional handles (FIG. 2), the handbag 10 can be worn by the handles or by the chain 16 in the folded down position.

In some implementations, the handbag 10 includes one or more inner pockets 36 that can be easily accessed in the folded down position. In some cases, the interior of the body 12 can include one or more lights 38 that illuminate the inside of the body 12 (FIGS. 1C and 1E). For example, the one or more lights 38 can include LED lights, e.g., multiple individual LED lights or a LED strip arranged along the bottom of the body 12. The lights 38 can be attached to a surface of an inner lining of the base 20. In some cases, the material of the inner lining can be somewhat transparent, and the one or more lights 38 can be arranged behind the inner lining. For example, the handbag 10 can include a battery or other power supply (not shown) to power the one or more lights 38. Alternatively, the light 38 can be removable in a similar manner to a keychain. In some variations, the LED lights are designed to emit bright light that makes it easy to identify objects inside of the handbag 10. In other variations, the LED lights may be designed to emit an ambient glow or to change colors, thus enhancing the handbag's appearance.

In the folded down position shown in FIG. 1D, the opening 22 of the handbag 10 is exposed. In order to secure the belongings carried in the handbag in the folded down position, some versions of the handbag 10 can include optional inner flaps 40 that can be closed by a zipper 42. Each flap 40 can include a long edge 44 that is connected to an inner surface of a corresponding side 18*a*, 18*b* and a short edge 46. The short edge 46 can be connected to the base 20, such that the opening 22 is fully closed when the inner flaps 40 are zippered shut. In the example depicted in FIG. 1C, the long edge 44 of each inner flap 40 is connected to the sides 18*a*, 18*b*, while a gap is formed between the base 20 and the short edge 46 of each flap 40. Instead of having inner flaps 40 that close off the entire opening 22, some designs of the handbag 10 can include a small, zippered compartment (not shown) for valuable belongings.

From either the folded down or the upright positions, the flaps 14*a*, 14*b* can be folded inwards and towards each other until the flaps 14*a*, 14*b* overlap, as shown, e.g., in FIGS. 1E-1F. In the overlapping position, the flaps 14*a*, 14*b* are positioned to substantially close the handbag opening 22 to secure the belongings stored in the body 12. As shown, e.g., in the top view of FIG. 1E, the peripheral magnets 26*a*, 26*b* of each flap 14*a*, 14*b* can attach to corresponding magnets 26*a*, 26*b*, 28*a*, 28*b* of the other flap 14*a*, 14*b* to secure the flaps 14*a*, 14*b* in place. The magnets 26*a*, 26*b* can be formed by magnetic strips that extend along the upper half of the circular edge of each side 18*a*, 18*b* of the handbag 10. As also shown in FIG. 1A, two magnetic strips extend horizontally across the sides 18*a*, 18*b* of the handbag 10 to form a flap magnet 28*a*, 28*b* and a body magnet 30*a*, 30*b*, respectively. The flap magnet 28*a*, 28*b* is designed to attach to the topmost peripheral magnet 26*a*, 26*b* of the opposing flap 14*a*, 14*b* when the flaps 14*a*, 14*b* are in the overlapping position shown in FIG. 1E. The body magnets 30*a*, 30*b* are designed to attach to the topmost peripheral magnet 26*a*, 26*b* of the same side 18*a*, 18*b* when the flaps 14*a*, 14*b* are in the folded down position (FIG. 1D).

When the flaps 14*a*, 14*b* are in the overlapping position, the handbag 10 has an overall height that is similar to the height in the folded down position shown in FIG. 1D. Although the handbag 10 of FIGS. 1A-1F is shown with three peripheral magnets 26*a*, 26*b* arranged on each flap 14*a*, 14*b*, other versions of the handbag 10 can include a single magnet arranged along the edge of the flap 14*a*, 14*b*. For example, the single magnet can be arranged at the top of the circular side 18*a*, 18*b* and designed to attract the flap magnet 28*a*, 28*b* of the opposite flap 14*a*, 14*b* in the overlapping configuration or the body magnet 30*a*, 30*b* of the same flap 14*a*, 14*b* in the folded down configuration.

Not only do the different flap configurations change the appearance of the handbag 10, they adapt the handbag 10 to a variety of functions and situations. For instance, depending on the overall size of the handbag 10, the handbag 10 can is similar to a chain wallet or crossbody bag when the flaps 14*a*, 14*b* are in the overlapping position shown, e.g., in FIGS. 1E-1F. Since the flaps 14*a*, 14*b* are held in a closed position, the wearer's belongings remain relatively secure. However, chain wallets and crossbody bags are often limited in size, making it difficult to hold certain belongings. By arranging the flaps 14*a*, 14*b* in the upright position shown, e.g., in FIG. 1A, the same handbag 10 is now able to store larger or longer belongings that do not fit inside the body 12 when the flaps 14*a*, 14*b* are in the overlapping position. Conversely, when the handbag 10 is implemented in a large size, it may be difficult to find belongings along the bottom of the body 12. When the flaps 14*a*, 14*b* are secured in the folded down position shown in FIGS. 1E-1F, the wearer may be able to find such items more easily. As described, the illustrated handbag 10 is multi-functional, but maintains a pleasing and stylish appearance that is not often found amongst more utilitarian bags (e.g. foldable shopping bags).

Although several flap configurations are illustrated in FIGS. 1A-1F, further configurations are also possible. For example, the flaps 14*a*, 14*b* can be folded downward, into the body 12, and secured by the magnets 26*a*, 26*b*, 30*a*, 30*b*. In some cases, the flaps 14*a*, 14*b* can be secured shut in the upright position shown in FIG. 1A by engaging the peripheral magnets 26*a*, 26*b* with one another. From this position, the flaps 14*a*, 14*b* could be folded down to one side 18*a*, 18*b* in the style of a satchel.

Figure 2A:
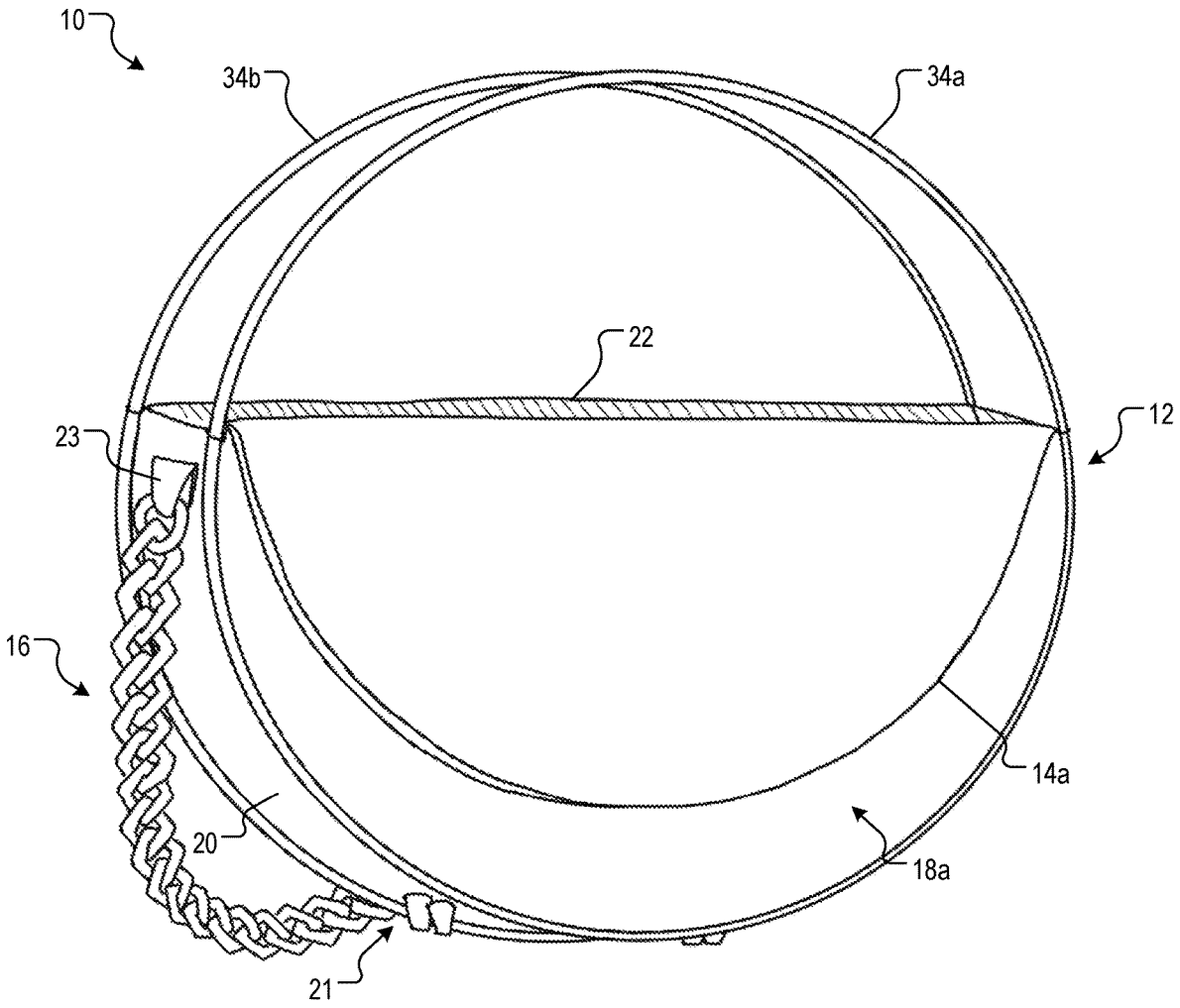
FIG. 2A-2C depict different examples of the handbag that each include removable hoop-shaped handles.
Figure 2B:
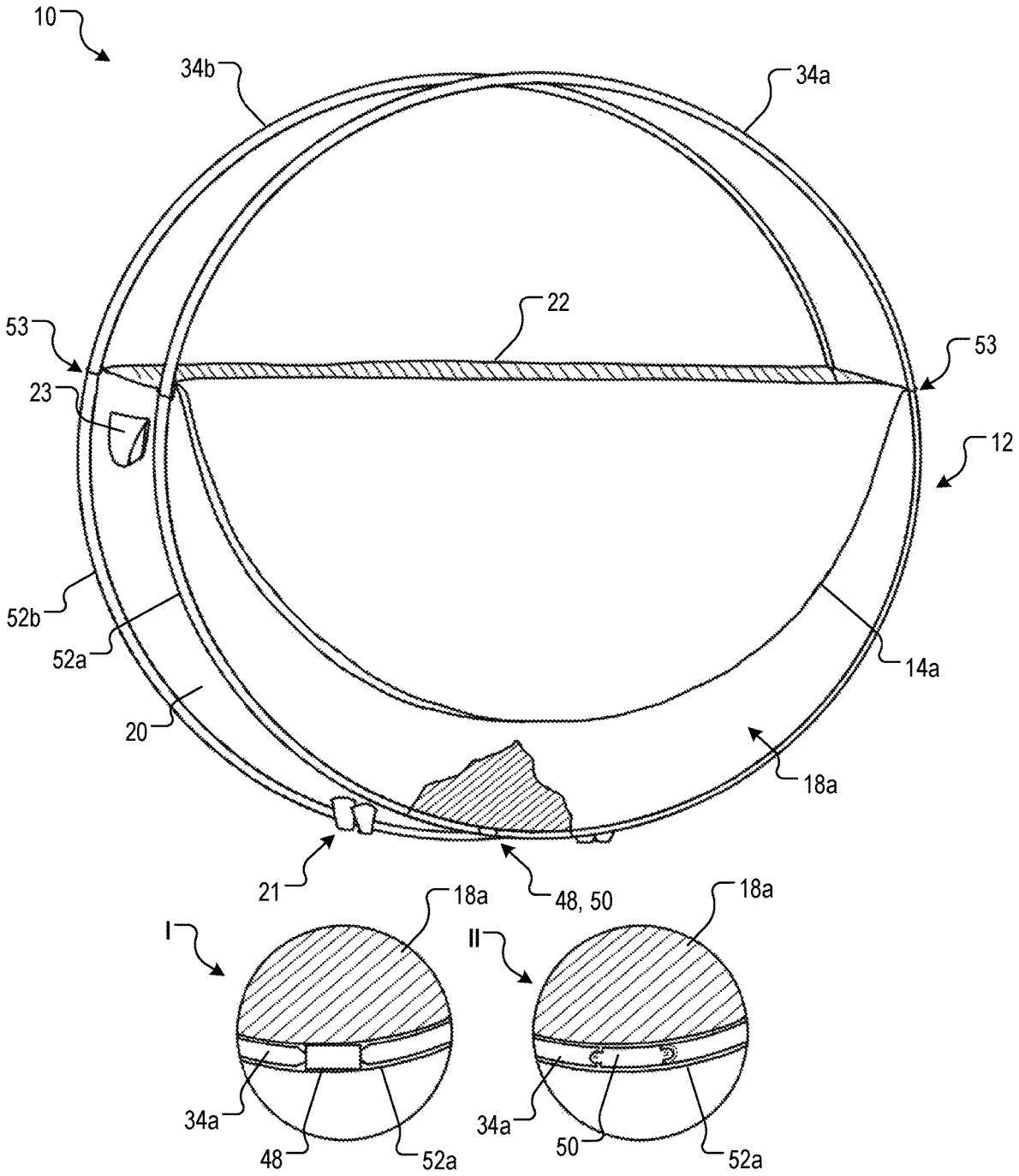
Figure 2C:
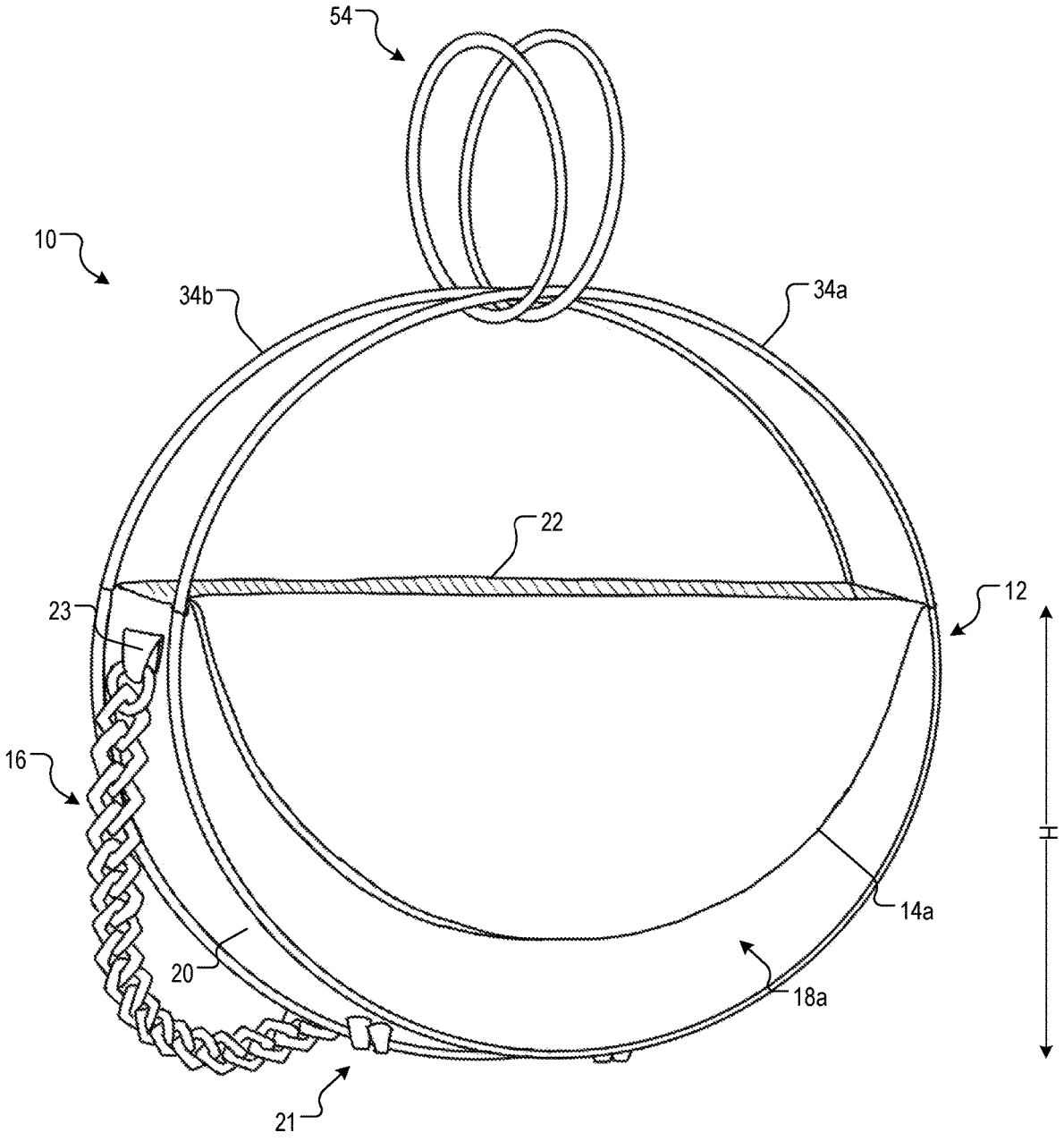

FIG. 2A-2C depict different examples of the handbag 10 that each include removable hoop-shaped handles 34*a*, 34*b*. As shown in FIG. 2A, each hoop 34*a*, 34*b* may form a short handle, whereas the chain 16 or strap forms a long handle. Each hoop 34*a*, 34*b* includes a wire, e.g., made of metal, that is bent to form a discontinuous hoop. In the context of this disclosure, discontinuous means that a gap can be formed between the ends of the metal wire, as shown in FIG. 2B.

FIG. 2B depicts the handbag 10 of FIG. 2A with the chain 16 removed and a portion of the circular side 18*a* cut away to reveal the ends of the hoop 34*a*. Reference signs I and II are enlarged examples of the cutaway portion. For example, as indicated by reference sign I, the ends of the wire that forms the hoop 34*a* can be attached and detached via a screw connector 48. Although the screw connector 48 is schematically shown by a single part, in some cases, each end of the wire may include half of the screw connector 48 that can be mated to form the hoop in a manner similar to a screw clasp for jewelry. As shown by reference sign II, other versions can include a spring-loaded gate 50 that is similar to the mechanism used in a carabiner. However, different attachments for the wire ends can be used than the one shown. For example, the gate 50 and the screw connector 48 can be combined in the manner of a screw gate or locking carabiner. The ends of the wire are initially closed by a spring-loaded gate, and a threaded sleeve is rotated over the gate to secure the gate in place. In some cases, the wire may be made of a relatively stiff material and the ends of the wires may not be attached at all.

The discontinuous design of the hoops 34*a*, 34*b* allows the wearer to remove the handles from the handbag 10 when desired. For example, as shown in FIG. 2B, the body 12 of the handbag 10 may include a channel 52*a*, 52*b* along the seam where the circular sides 18*a*, 18*b* meet the base 20. Each channel 52*a*, 52*b* may be configured to receive a respective hoop 34*a*, 34*b*. For example, one end of the hoop 34*a*, 34*b* can be inserted into a channel opening 53 adjacent to the opening 22 of the handbag 10. The hoop 34*a*, 34*b* can be threaded through the channel 52*a*, 52*b* until the end emerges through the opposite opening 53 of the channel 52*a*, 52*b*. Once the hoop 34*a*, 34*b* is threaded through the channel, the exposed ends can be connected, e.g., by the connector 48, 50. In order to prevent the ends of the wire from accidentally disengaging, the hoop 34*a*, 34*b* can be rotated in a clockwise or counter-clockwise direction until the connector 48, 50 is located inside of the channel 52*a*, 52*b*. For example, FIG. 2B depicts the connector 48, 50 at the bottom of the handbag 10, adjacent to the handbag's feet 21.

The handbag 10 can be worn by either the hoops 34*a*, 34*b* or the chain 16. Alternatively, the chain 16 and the hoops 34*a*, 34*b* can both be attached to the handbag 10, as shown in FIG. 2A. The discontinuous hoop design makes it possible to thread smaller rings 54 onto the hoops 34*a*, 34*b* that provide additional handles (FIG. 2C). However, it is also contemplated that the handbag 10 is provided with hoop-shaped handles that are not removable. For example, a discontinuous hoop may initially be provided during the manufacturing process, and the ends of the hoop may be permanently attached to one another (e.g. by welding). Although FIG. 2A-2C show the handbag 10 with the flaps 14*a*, 14*b* in the folded down position, the flaps 14*a*, 14*b* can be rearranged into the upright or overlapping positions described above.

Depending on the material of the body 12 and the flaps 14*a*, 14*b*, the handbag body 12 may be compressed or "scrunched" along the hoops 34*a*, 34*b* to give the bag a different size and overall appearance relative to the handles. For example, scrunching the body 12 may reduce the height H of the body 12 shown in FIG. 2C.

Figure 3:
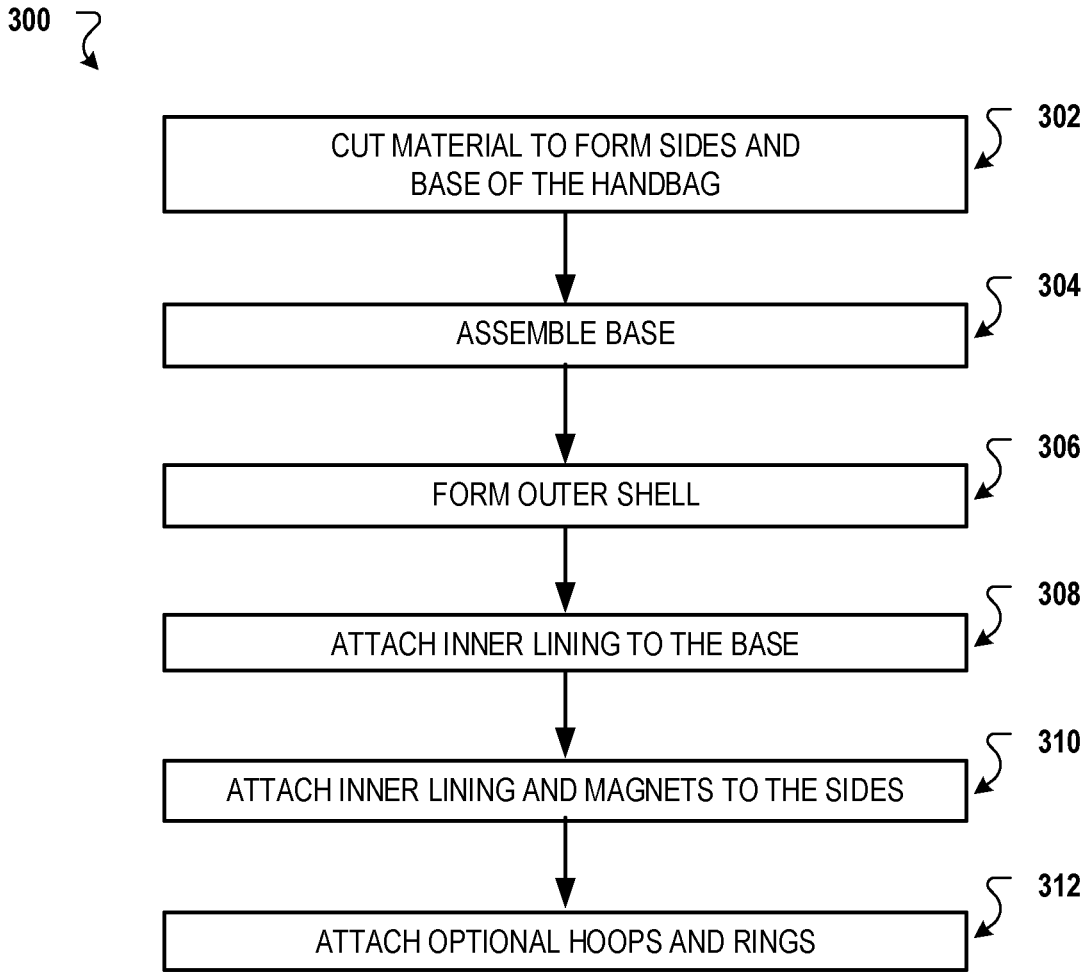
FIG. 3 is a flow chart of an example process for manufacturing the handbag of FIGS. 1A-1F and 2A-2C.

FIG. 3 is a flow chart of an example process 300 for manufacturing the handbag 10 shown in FIGS. 1A-1F and 2A-2C. FIGS. 4A-4G depict details of the process 300 of FIG. 3. Although the illustrated handbag has circular sides, the process 300 can be implemented for handbags having a different shape (e.g. oval or diamond-shaped).

Figure 4A:
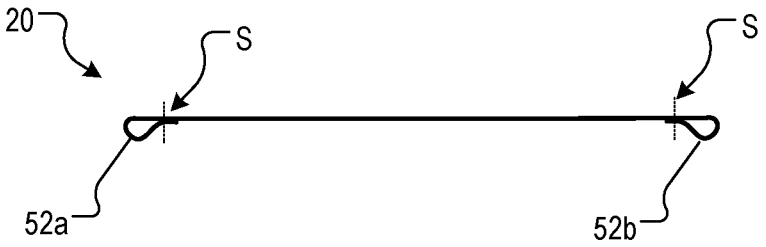
FIGS. 4A-4G depict details of the process of FIG. 3
Figure 4B:
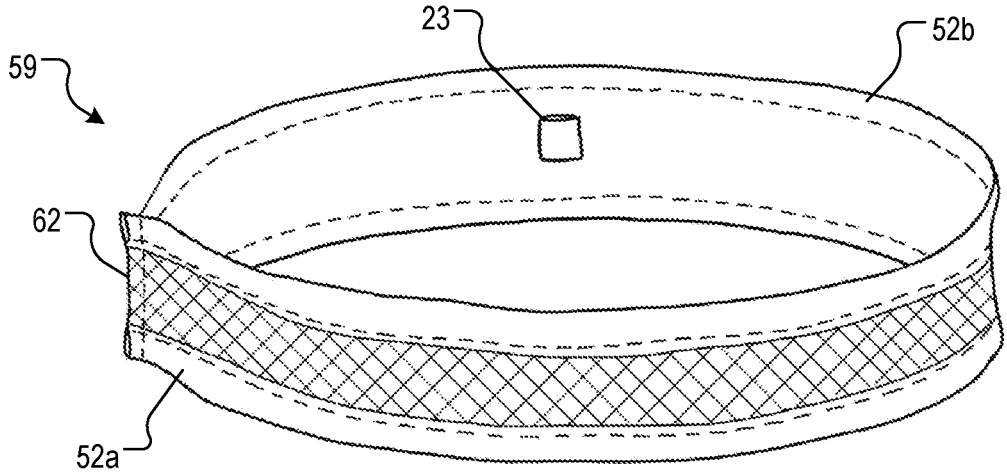
Figure 4C:
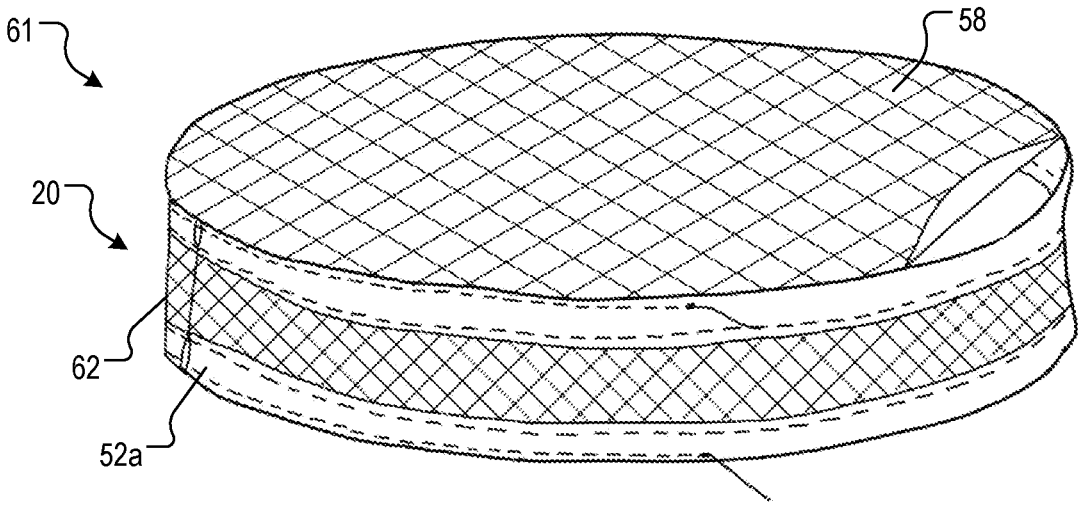
Figure 4D:
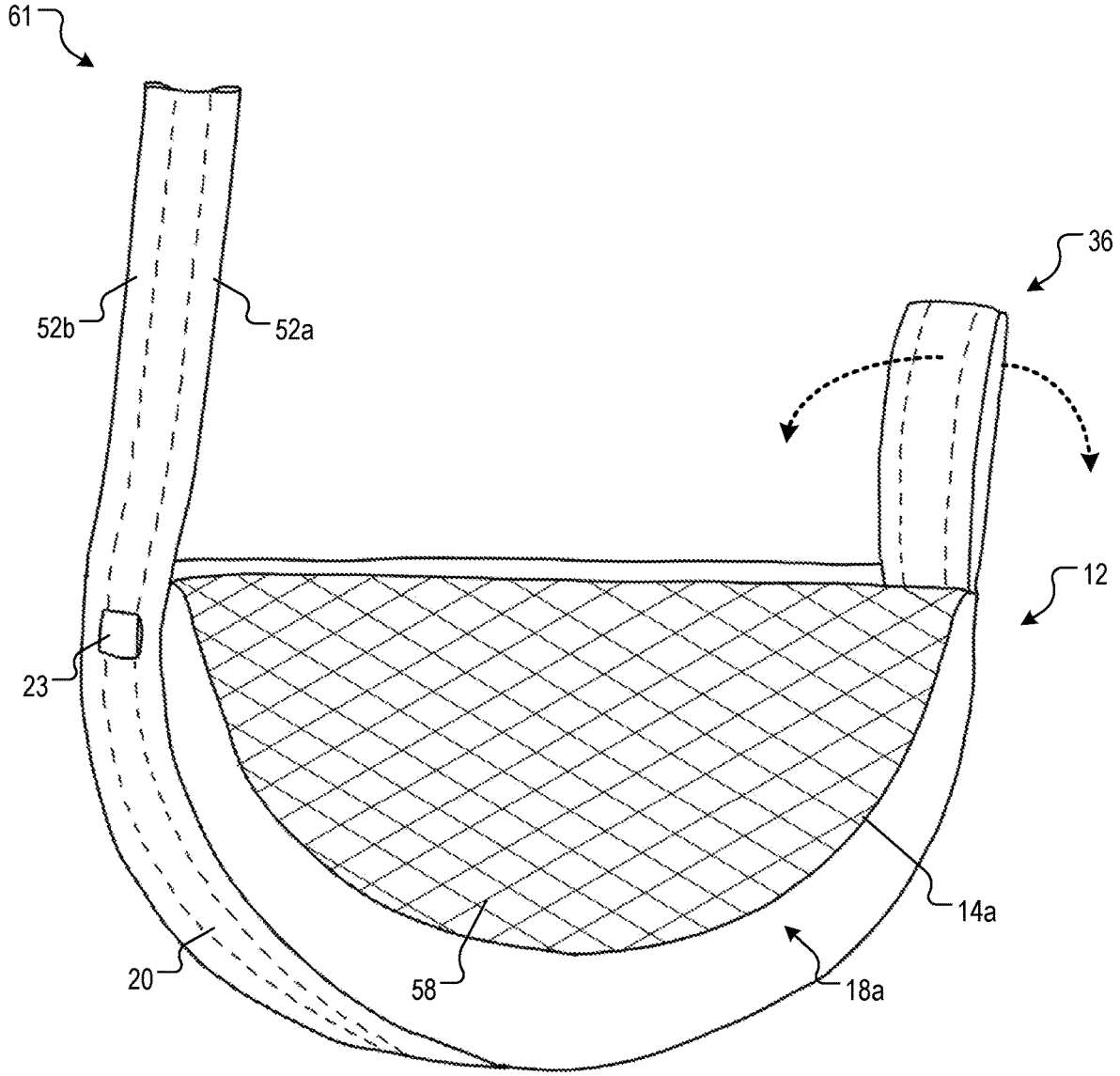

At 302, material (e.g., leather or vegan leather) is cut to form the sides 18*a*, 18*b* and base 20 of the handbag 10. For example, the sides 18*a*, 18*b* and the base 20 can be cut from a large piece of the outer material of the handbag 10. As described previously, the handbag 10 includes two circular sides 18*a*, 18*b* that are connected by a rectangular base 20. Each side 18*a*, 18*b* can include two circular pieces of material that form an inner and outer lining 56, 58, respectively (FIG. 4F). In some cases, the inner and outer lining 56, 58 are formed by the same material. In other cases, the material may be different in appearance or texture, for example. In FIGS. 1A-1F and 2A-2C, each side 18*a*, 18*b* includes an integrally formed flap 14*a*, 14*b*. In other examples, the flaps 14*a*, 14*b* may be attached along a seam (e.g., that extends along the fold line of the flap 14*a*, 14*b*). As described in more detail below, a circular piece of interfacing 60 can be layered between the inner and outer lining 56, 58 to make the body 12 and flaps 14*a*, 14*b* more rigid (FIG. 4F). The base 20 includes a rectangular strip that can form both the inner and outer lining and can also include a piece of interfacing between the inner and outer lining. The material of the inner and outer lining 56, 58 can be selected and combined to change the bag's appearance. For example, the outer lining 58 of the sides 18*a*, 18*b* and base 20 and the inner lining 56 of the sides 18*a*, 18*b* can be made of the same material. The inner lining of the base 20 can be made of a different material, e.g., a material having a contrasting color to the other material, to make the belongings stored in the bag easier to see. However, any combination of outer linings and inner linings may be contemplated. Further, although FIGS. 1A-1F and 2A-2C depict the sides 18*a*, 18*b* of the body 12 as a single piece of material, the sides 18*a*, 18*b* may also be formed from two half-circles of different material that are sewn together.

At 304, the base 20 is assembled. For example, long edges of the outer lining of the base 20 can be folded over towards each other and sewn or glued to form channels 52*a*, 52*b* for the hoops 34*a*, 34*b*. FIG. 4A shows a cross-section of the base 20 and the channels 52*a*, 52*b* that are formed by folding over the edges of the base 20 and sewing the edges along the seams S. Since the base 20 is still flat at this stage, hardware for attaching the shoulder chain 16, e.g., the loop 23, can also be added to the outer lining of the base 20. Although the example handbag 20 in the drawings is shown with a shoulder chain 16, other types of fabric or leather shoulder straps can also be used.

At 306, an outer shell 61 of the handbag 10 can be formed. Initially, the short edges 62 of the outer lining of the base 20 are joined together to form a fabric loop 59 with the same diameter as the sides 18*a*, 18*b* of the handbag 10, as shown in FIG. 4B. The loop 59 can then be turned inside out, and the outer lining 58 of the sides 18*a*, 18*b* of the handbag 10 can be sewn to the fabric loop 59 with the wrong sides of the outer linings 58 facing inwards to form the shell 61, as shown in FIG. 4C. In FIG. 4C, the cross-hatching indicates the wrong side of the fabric. The seam formed by the short edges 62 can be optionally arranged so that it aligns with the bottom of the base 20 to give the base 20 greater integrity. The outer lining 58 of each side 18*a*, 18*b* is sewn to the base 20 along the bottom half of its perimeter. The shell 61 can then be turned inside out, and the top portion of the base 20 is cut opposite the seams formed by the short edges 62, as shown in FIG. 4D. The excess fabric of the outer lining of the base 20 can be folded onto itself to form optional inner pockets 36 that can be turned inward and outward, as shown by the arrows in FIG. 4D. For example, the pockets 36 can be accessed by a slit formed in the fabric of the base 20 (not shown).

Some implementations may simply leave the short edges 62 of the outer lining of the base 20 unattached. The shell 61 can be formed by sewing the outer linings 58 to the long edge of the base 20 to form the structure depicted in FIG. 4D.

Optionally, feet 21 can be glued to the bottom of the base 20, i.e., to the outer lining, to enable the round handbag 10 to stand on a flat surface.

Figure 4E:
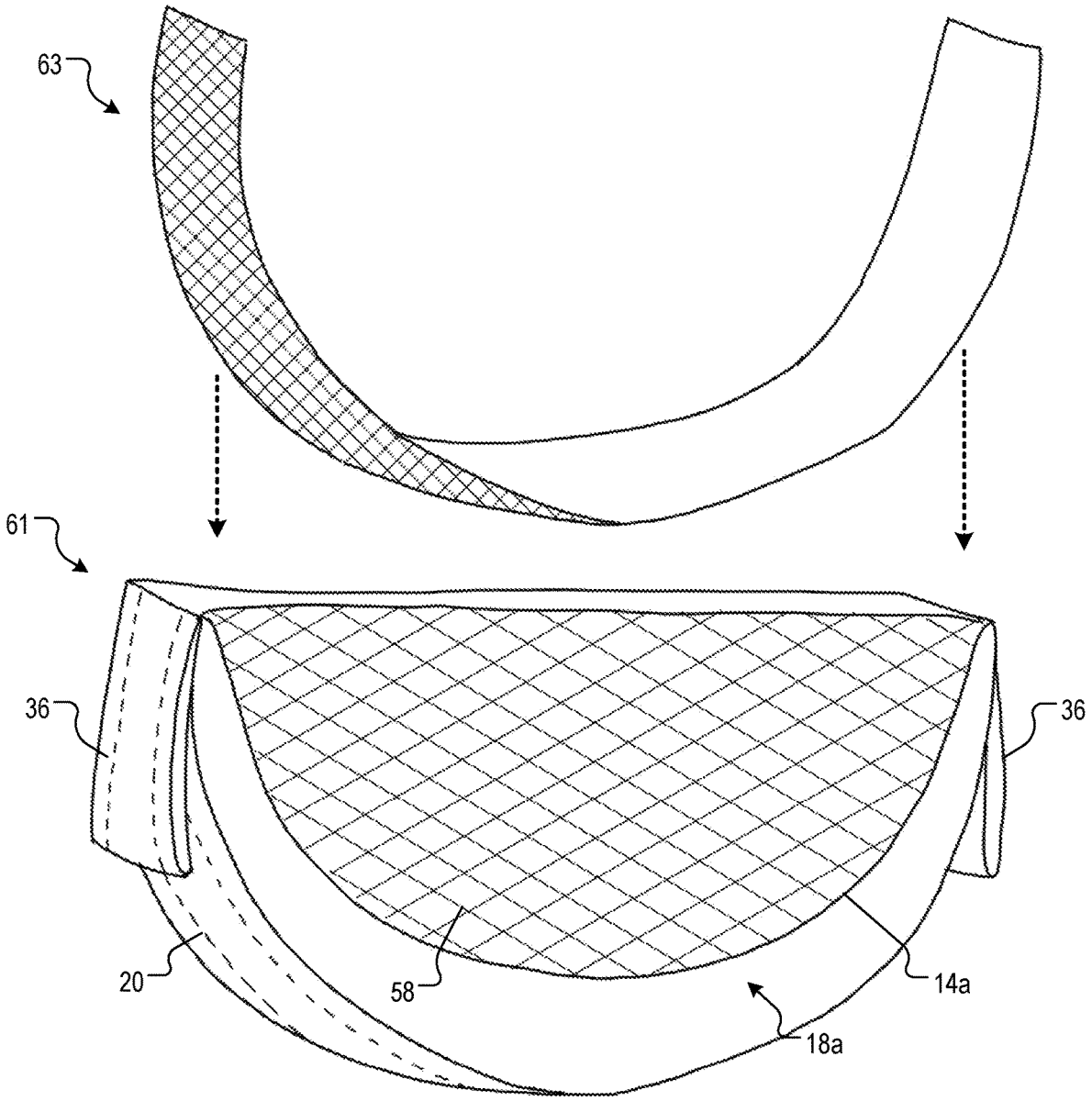
Figure 4F:
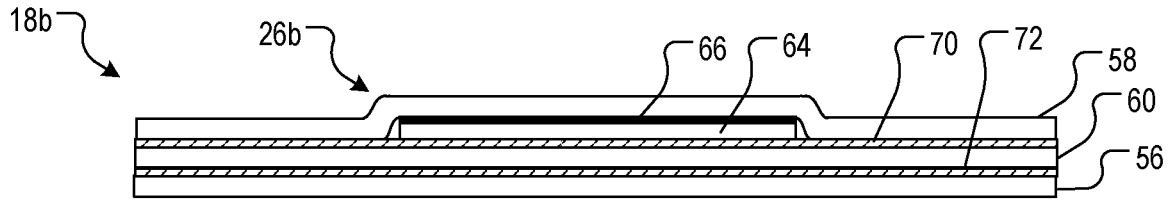

At 308, the inner lining 63 and optional interfacing of the base 20 are attached to the shell 61, as shown by the arrows in FIG. 4E. For example, the interfacing and inner lining 63 may be attached by a layer of adhesive (not shown). In some cases, the interfacing is heat fused to either the inner lining 63, the outer lining, or both. In some cases, the interfacing and inner lining 63 of the base 20 can be attached separately from the interfacing 60 and inner lining 56 of the sides 18*a*, 18*b*, as shown in FIG. 4E. In other cases, the interfacing 60 and inner lining 56 of the base 20 and sides 18*a*, 18*b* could also be sewn together to form an inner shell and inserted into the shell 61 of the handbag in a single step.

Referring now to FIG. 4F, the inner lining 56, the interfacing 60, and the magnets 26*a*, 26*b*, 28*a*, 28*b*, 30*a*, 30*b* are attached to the sides 18*a*, 18*b* of the handbag 10 at 310. Specifically, FIG. 4F is a cross-sectional view through the side 18*b* along line in FIG. 1B. Although FIG. 4F only depicts one side 18*b* and a single peripheral magnet 26*b*, the same techniques can be used to attach the other magnets 26*b*, 28*b*, 30*b* as well as form the other side 18*a*. As previously described, the side 18*b* includes an inner lining 56, an optional interface layer 60, and an outer lining 58. As shown, e.g., in FIGS. 4C-4E, the outer lining 58 is already attached to the base 20 and forms an outer shell 61 of the handbag.

Figure 4G:
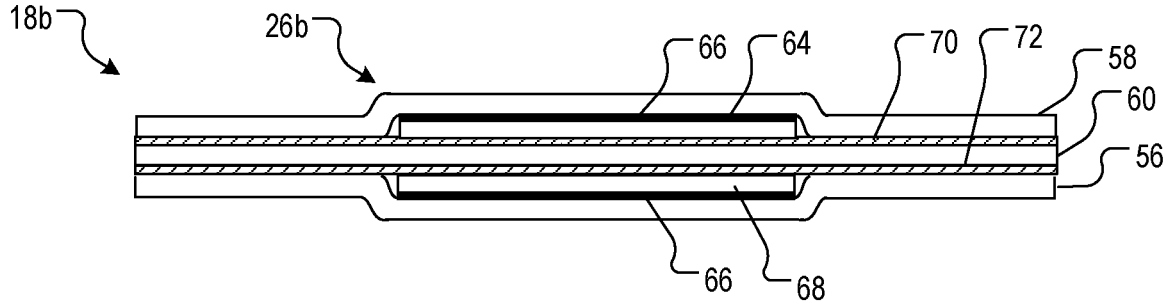

For example, a first magnetic strip 64 that forms part of the topmost peripheral magnet 26*b* can be attached to the wrong side of the outer lining 58 by an adhesive backing 66. Although FIG. 4F depicts a magnetic strip 64, other shapes of magnets can also be used. Next, the circular interfacing 60 is attached to the wrong side of the outer lining, e.g., by an adhesive layer 70. The circular inner lining 56 is then attached to the interfacing 60 with the wrong side of the inner lining 56 facing the interfacing 60. For example, the inner lining 56 can be attached to the interfacing 60 by a further adhesive layer 72. In this way, the magnets 26*a*, 26*b*, 28*a*, 28*b*, 30*a*, 30*b* can be attached to the inside of the flap 14*a*, 14*b* and body 12 so as not to be visible from the outside. Depending on the thickness of the material, a single magnetic strip 64 may be attached to the wrong side of the outer or inner lining 58, 56 and used to secure the flaps 14*a*, 14*b* in both the overlapping and folded down positions. However, in some cases, a further magnetic strip 68 may be attached to the corresponding location of the inner lining 56 to form a magnet pair with the magnetic strip 64 attached to the outer lining 58, as shown in FIG. 4G. In this case, the poles of each magnet pair are arranged so that they attract one another.

As described above, implementations of the handbag 10 may not necessarily use magnets 26*a*, 26*b*, 28*a*, 28*b*, 30*a*, 30*b*. In such cases, other types of fasteners (e.g., snaps or hook and loop strips) may be arranged in the locations depicted in FIGS. 1A to 1F to secure the flaps 14*a*, 14*b* of the handbag 10 in the described positions. For some fastener types, the fastener may need to be attached to the outer surface of the inner or outer lining 56, 58 (as opposed to the wrong side, as depicted in FIGS. 4F-4G) and to both the inner and the outer lining 56, 58.

At 318, the hoops 34*a*, 34*b* and optional rings 54 may be attached as described in reference to FIGS. 2B-2C. Further, an optional handle grip may be added to the top of the hoops 34*a*, 34*b* to make the handbag 10 easier to carry.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results.

What is claimed is:

1. A handbag comprising:

a bag-shaped body that defines (i) an opening for receiving personal items, and (ii) a pair of longitudinal channels that extend along a periphery of the body, wherein each channel receives a hoop-shaped handle that encircles the body; and a first and second flap each attached to the body along opposing edges of the opening, wherein the first and second flaps can be secured in a first position, in which the flaps overlap one another to substantially close the opening of the body, and in a second position, in which each flap extends away from the opening, along a side of the body;

wherein the first flap and the body define a first circular side, and the second flap and the body define a second circular side; and wherein the first flap comprises first peripheral magnets arranged along the periphery of the first flap, and the second flap comprises second peripheral magnets arranged along the periphery of the second flap, wherein the first peripheral magnets are configured to engage the second peripheral magnets when the first flap and second flap are arranged in the first position.

2. The handbag of claim 1, wherein the hoop-shaped handles are made of a ferromagnetic material that attracts the first peripheral magnets and the second peripheral magnets.

3. The handbag of claim 1, wherein each of the hoop-shaped handle comprises a carabiner connecter that allows the hoop-shaped handle to be removed from the longitudinal channel.

4. The handbag of claim 3, further comprising a pair of rings threaded on the hoop-shaped handles, wherein the pair of rings have a substantially smaller diameter than the hoop-shaped handles.

5. The handbag of claim 1, further comprising a detachable chain or strap configured to connect to the bag-shaped body.

6. The handbag of claim 1, wherein the body comprises a first body magnet and a second body magnet, wherein in the second position, at least one of the first peripheral magnets is configured to engage the first body magnet, at least one of the second peripheral magnets is configured to engage the second body magnet.

7. The handbag of claim 1, further comprising a first inner flap and a second inner flap that are arranged to close off the opening of the body in the second position of the first and second flaps.

8. The handbag of claim 1, further comprising a light configured to illuminate an interior of the body.

9. The handbag of claim 1, further comprising a pocket arranged in an interior of the body.

* * * * *